US011603741B2

(12) United States Patent
Organ et al.

(10) Patent No.: US 11,603,741 B2
(45) **Date of Patent: *Mar. 14, 2023**

(54) SYSTEM AND METHOD FOR RESTORATION OF SAFETY INTEGRITY LEVEL (SIL) CAPABILITY IN A SUBSEA INSTALLATION

(71) Applicant: Dril-Quip, Inc., Houston, TX (US)

(72) Inventors: Mark Edwin Organ, Singapore (SG); Duncan Stuart Hogg, Singapore (SG)

(73) Assignee: Dril-Quip, Inc., Houston, TX (US)

( * ) Notice: Subject to any disclaimer, the term of this patent is extended or adjusted under 35 U.S.C. 154(b) by 0 days.

This patent is subject to a terminal disclaimer.

(21) Appl. No.: 17/838,435

(22) Filed: Jun. 13, 2022

(65) Prior Publication Data

US 2022/0307349 A1 Sep. 29, 2022

Related U.S. Application Data

(63) Continuation of application No. 17/316,000, filed on May 10, 2021, now Pat. No. 11,391,123.

(60) Provisional application No. 63/022,747, filed on May 11, 2020.

(51) Int. Cl.

| | |
|---|---|
| ***E21B 41/00*** | (2006.01) |
| ***E21B 41/04*** | (2006.01) |
| ***E21B 43/01*** | (2006.01) |
| ***E21B 47/00*** | (2012.01) |
| ***E21B 47/001*** | (2012.01) |

(52) U.S. Cl.

CPC ..... *E21B 43/01* (2013.01); *E21B 41/0007* (2013.01); *E21B 47/001* (2020.05); *E21B 41/04* (2013.01)

(58) Field of Classification Search

CPC ..... E21B 41/0007; E21B 41/04; E21B 43/01; E21B 47/001

See application file for complete search history.

(56) References Cited

U.S. PATENT DOCUMENTS

| | | | | |
|---|---|---|---|---|
| 6,880,567 | B2 * | 4/2005 | Klaver | F16K 37/00 137/557 |
| 11,391,123 | B2 * | 7/2022 | Organ | E21B 41/0007 |
| 2011/0061861 | A1 * | 3/2011 | Flanders | E21B 47/008 166/250.01 |

(Continued)

FOREIGN PATENT DOCUMENTS

WO 2016/061444 A1 4/2016

OTHER PUBLICATIONS

Search Report issued in related Great Britain Patent Application No. 2106643.6 dated Feb. 8, 2022, 1 page.

*Primary Examiner* — Matthew R Buck
(74) *Attorney, Agent, or Firm* — Baker Botts L.L.P.

(57) ABSTRACT

A well production system comprises a safety instrumented system (SIS) having one or more logic solvers; one or more pressure transmitters disposed along a flowpath and communicatively coupled to the one or more logic solvers; one or more valves disposed along the flowpath and communicatively coupled to the SIS, wherein the SIS is configured to selectively actuate the one or more valves based on feedback from the one or more pressure transmitters; and a spare pressure transmitter disposed along the flowpath, wherein the spare pressure transmitter is configured to be selectively coupled to the one or more logic solvers.

20 Claims, 13 Drawing Sheets

(56) References Cited

U.S. PATENT DOCUMENTS

| | | | | |
|---|---|---|---|---|
| 2018/0023360 | A1* | 1/2018 | Flanders | E21B 43/00 166/53 |
| 2018/0073320 | A1 | 3/2018 | Holmes et al. | |
| 2018/0245452 | A1* | 8/2018 | Mujica | G01V 11/002 |
| 2019/0294184 | A1* | 9/2019 | Al Khunaizi | G01M 3/2876 |

* cited by examiner

SYSTEM AND METHOD FOR RESTORATION OF SAFETY INTEGRITY LEVEL (SIL) CAPABILITY IN A SUBSEA INSTALLATION

CROSS-REFERENCE TO RELATED APPLICATIONS

The present application is a Continuation of U.S. application Ser. No. 17/316,000 filed May 10, 2021, which claims priority to and the benefit of U.S. Provisional Application No. 63/022,747 filed May 11, 2020, both of which are hereby incorporated by reference as if reproduced in their entirety.

TECHNICAL FIELD

The present disclosure relates generally to subsea well systems and, more particularly, to systems and methods for restoration of safety integrity level (SIL) capability in a subsea installation.

BACKGROUND

Offshore oil and gas operations typically involve drilling a wellbore through a subsea formation and disposing a wellhead at the upper end of the well (e.g., at the mudline). A string of casing can be landed in the wellhead. A tubing hanger lands in the wellhead (or a tubing spool connected to the wellhead), and the tubing hanger suspends a production tubing string through the wellhead into the casing string. A conventional production tree can be connected to the top of the wellhead (or tubing spool) to route product from the tubing hanger (and production tubing) toward a production riser. The production riser generally includes a series of riser pipes connected end to end to connect the subsea production components to, for example, a topside production facility. Such subsea systems are often used to extract production fluids from subsea reservoirs.

Recently, the oil and gas industry has begun to see increased activity and interest in developing a wider variety of offshore reservoirs. Specifically, there is an increased interest in developing high pressure high temperature (HPHT) subsea reservoirs. The term HPHT refers to wells that have mudline pressures in excess of 15,000 psi, temperatures in excess of 350 degrees F., or both. In an effort to develop such HPHT reservoirs, it is desirable to provide new methods and equipment to safely drill, complete, produce, and intervene on HPHT wells over the economic life of the well.

High integrity pipeline protection systems (HIPPS), or other barriers, can be used to divide system components between pressure ratings and allow for enhanced development of HPHT reservoirs. HIPPS and similar barriers generally include one or more valves, sensors, and a control system configured to adjust one or more barrier valves based on measurements read from the sensors. Typically when a pressure transmitter fails when used in a HIPPS, the integrity level is reduced thereby reducing system reliability. The HIPPS, or other barriers, are used to divide the system components between pressure ratings and can allow for enhanced development of HPHT reservoirs. A failed pressure transmitter alters the voting logic used by the system to determine whether or not to close certain valves, resulting in an increase in cost.

BRIEF DESCRIPTION OF THE DRAWINGS

For a more complete understanding of the present disclosure and its features and advantages, reference is now made to the following description, taken in conjunction with the accompanying drawings, in which.

DETAILED DESCRIPTION

Figure 1:
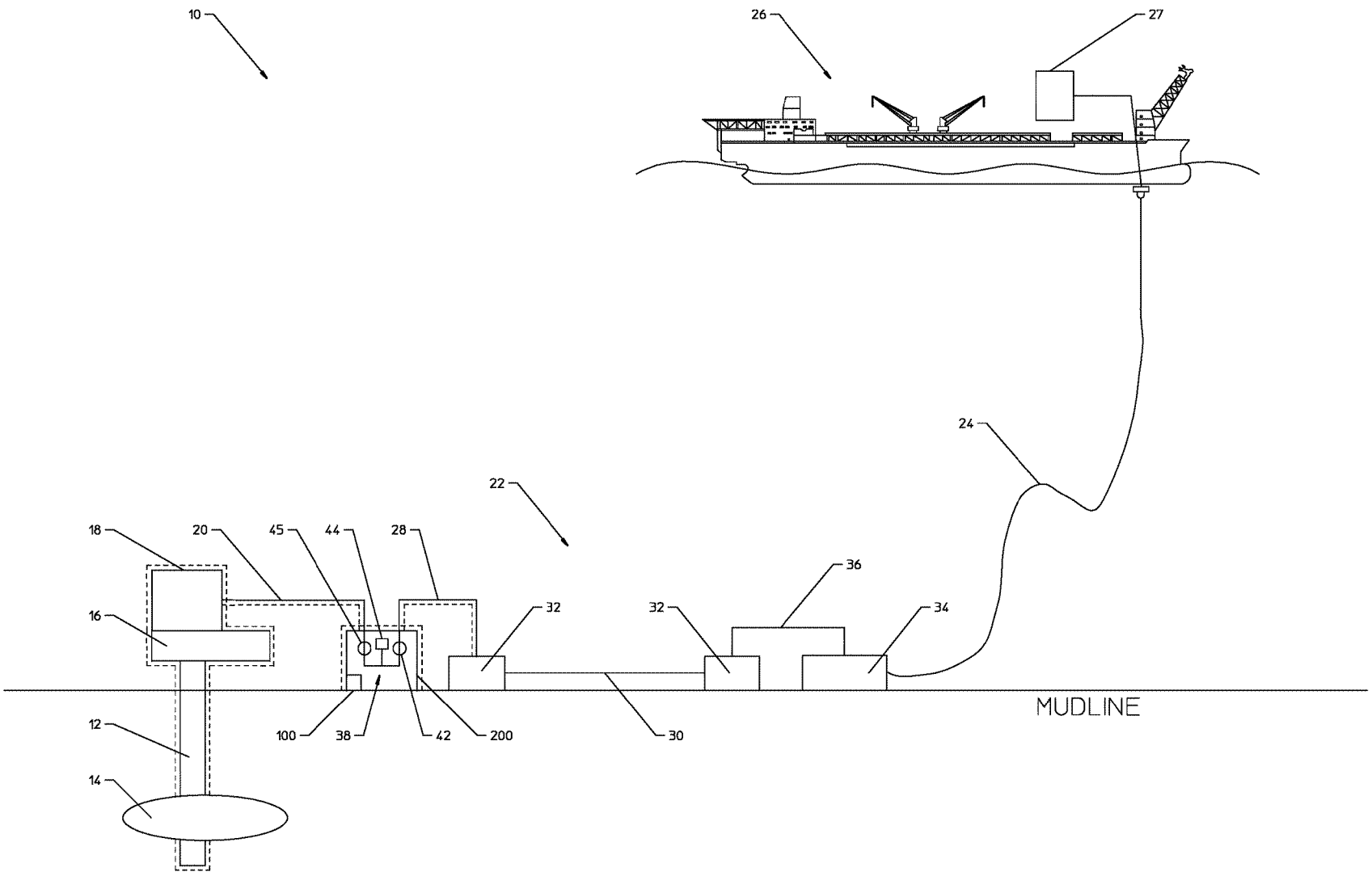
FIG. 1 is a schematic block diagram of a subsea system used to produce fluids from a subsea HPHT well, in accordance with an embodiment of the present disclosure.

Illustrative embodiments of the present disclosure are described in detail herein. In the interest of clarity, not all features of an actual implementation are described in this specification. It will of course be appreciated that in the development of any such actual embodiment, numerous implementation specific decisions must be made to achieve developers' specific goals, such as compliance with system related and business-related constraints, which will vary from one implementation to another. Moreover, it will be appreciated that such a development effort might be complex and time consuming but would nevertheless be a routine undertaking for those of ordinary skill in the art having the benefit of the present disclosure. Furthermore, in no way should the following examples be read to limit, or define, the scope of the disclosure.

For purposes of this disclosure, an information handling system may include any instrumentality or aggregate of instrumentalities operable to compute, classify, process, transmit, receive, retrieve, originate, switch, store, display, manifest, detect, record, reproduce, handle, or utilize any form of information, intelligence, or data for business, scientific, control, or other purposes. For example, an information handling system may be a personal computer, a network storage device, or any other suitable device and may vary in size, shape, performance, functionality, and price. The information handling system may include random access memory (RAM), one or more processing resources such as a central processing unit (CPU) or hardware or software control logic, ROM, and/or other types of nonvolatile memory. Additional components of the information handling system may include one or more disk drives, one or more network ports for communication with external devices as well as various input and output (I/O) devices, such as a keyboard, a mouse, and a video display. The information handling system may also include one or more buses operable to transmit communications between the various hardware components.

For the purposes of this disclosure, computer-readable media may include any instrumentality or aggregation of instrumentalities that may retain data and/or instructions for a period of time. Computer-readable media may include, for example, without limitation, storage media such as a direct access storage device (e.g., a hard disk drive or floppy disk drive), a sequential access storage device (e.g., a tape disk drive), compact disk, CD-ROM, DVD, RAM, ROM, electrically erasable programmable read-only memory (EEPROM), and/or flash memory; as well as communications media such wires, optical fibers, microwaves, radio waves; and/or any combination of the foregoing.

Certain embodiments according to the present disclosure may be directed to a subsea system and an associated method for completion, production, and intervention on high pressure and/or high temperature (HPHT) subsea wells. The system may be utilized for transporting oil, gas, and other fluids from a subsea well to an offshore production facility. High integrity pipeline protection systems (HIPPS), or other barriers, can be used to divide system components between pressure ratings and allow for enhanced development of HPHT reservoirs. HIPPS and similar barriers generally include one or more valves, sensors, and a control system configured to adjust one or more barrier valves based on measurements read from the sensors In existing systems, when a pressure transmitter fails, the voting logic of the HIPPS is altered to actuate at least one valve to close within a flowpath when at least one of the remaining pressure transmitters outputs pressure signals of high pressure. This increases the likelihood of unnecessarily closing valves, thereby decreasing the reliability of the production system. By reconfiguring a spare pressure transmitter in present embodiments to be communicatively coupled to the HIPPS when one or more pressure transmitters fails, the original voting logic may be restored, so that the valve is actuated closed within the flowpath when at least two of the remaining pressure transmitters output pressure signals of high pressure. As such, the disclosed system helps to maintain a higher reliability for the production system.

Turning now to the drawings, FIG. 1 schematically illustrates a subsea well production system 10 in accordance with an embodiment of the present disclosure. The production system 10 may include, for example, a wellhead 12 targeting a production zone 14 within a reservoir. In some embodiments, the production zone 14 may be a high pressure and/or high temperature (HPHT). In some embodiments, the production system 10 may also include a production tubing head spool (THS) 16 connected to the top of the wellhead 12, a subsea production tree 18 connected above the wellhead 12 (and/or above the THS 16), and a well jumper 20 leading from the tree 18 to a flowline system 22. Although the illustrated embodiment of FIG. 1 shows a THS 16 above the wellhead 12, other embodiments of the system 10 may not include a THS. Further, the system 10 may include a riser 24 connected from the flowline system 22 to a topside production facility 26, and a subsea umbilical (not shown) to monitor and inject chemicals as required into the wellbore and subsea pipeline facilities. There may be an information handling system 27 disposed at a surface location about the topside production facility 26. The information handling system 27 may be disposed within, on top of, or combinations thereof of the production facility 26. In embodiments, the information handling system 27 may be configured to receive and transmit signals and to process data through wired and/or wireless means.

In the illustrated embodiment, the flowline system 22 may include a fortified well jumper 28, a flowline 30 with opposing flowline pipeline end terminations/manifolds (PLETs/PLEMs) 32 at opposite ends thereof, a riser PLET 34, and a flowline jumper 36 for coupling the flowline PLET/PLEM 32 to the riser PLET 34. The term "fortified well jumper" refers to a well jumper that is fully rated for the higher pressures/temperatures/flow rates expected from downhole (e.g., pressures up to 15,000 psi, 20,000 psi, or more). The various PLETs described herein may generally function as end points for associated flowlines. It should be noted that other numbers and relative arrangements of such flowline components, end terminals, manifolds, and jumpers may be used in other embodiments of the flowline system 22. For example, in some embodiments, a flowline pipeline end manifold (PLEM) may be substituted for one or both of the illustrated flowline PLETs 32, enabling multiple production wells to feed into the same production facility 26 via the riser 24.

The production system 10 of FIG. 1 may be designed for the production of hydrocarbons from the subsea production zone 14, which may be an HPHT production zone. In general, a HPHT production zone 14 may be categorized as having a subsea mudline pressure above approximately 15,000 psi and/or temperatures greater than approximately 350 degrees F. To develop such HPHT production zones 14, the disclosed production system 10 generally includes one or more components that form a pressure barrier 38 disposed upstream of the flowline system 22. In the illustrated embodiment, for example, the barrier 38 is disposed just downstream of the production tree 18 and is fluidly coupled to the tree 18 via the well jumper 20. It should be noted that in the present disclosure, the term "upstream" generally refers to the direction facing the subsea wellhead 12, while the term "downstream" generally refers to the direction facing the topside production facility 26.

In some embodiments, the barrier 38 may include a high integrity pipeline protection system (HIPPS) module 200. The HIPPS module 200 may be a skid-mounted system that features a control module 100 and a series of chokes 42, sensors 44, valves 45, and any combination thereof between the wellhead 12 and the flowline system 22. In embodiments, any suitable types of sensors and valves may be used. The chokes 42, sensors 44, valves 45, and any combination thereof may be used to regulate the fluid flowing through the production system 10. The control module 100 is used to control the pressure of production fluids and other fluids let through the barrier 38 in a particular direction, and to isolate an upstream pressure source from the downstream facilities (e.g., topside production facility 26). In embodiments, the control module 100 may be communicatively coupled to the information handling system 27. Without limitations, the control module 100 may be a Safety Instrumented System (SIS) that is used in conjunction with subsea valve interlocks provided via a subsea control system (not shown). The SIS may control these valves together to maintain a desired subsea operational state (i.e., maintaining a lower pressure downstream of the wellhead 12). In the illustrated embodiment, the barrier 38 may be provided as a separate skid unit with a control module 100 for keeping the pressure of production fluids below a desired threshold as the production fluid moves downstream from the HPHT production zone 14 to the topside production facility 26. Other embodiments of the barrier 38 may feature any other valves, chokes, and/or control components that are spread throughout the production system 10 or integrated into a more upstream component of the production system 10.

The barrier 38, and all equipment upstream of the barrier 38, may be rated for a maximum pressure, temperature, or flow rate that is equal to or greater than the maximum pressure, temperature, or flow rate of the HPHT production zone 14. The subsea system components that are rated for the higher pressure/temperature/flow rate are indicated by dashed lines in FIG. 1. In some embodiments, these components may be rated for a maximum pressure of beyond 15,000 psi and/or rated for temperatures of at least approximately 350 degrees F.

Downstream of the barrier 38, one or more pieces of wellbore equipment may be rated for a maximum pressure, temperature, or flow rate that is less than that of the upstream (higher rated) system components. This lower pressure/temperature/flow rating is indicated by solid (not dashed) lines in the illustrated embodiment. In some embodiments, these components may be rated for pressure of up to approximately 7,000 psi to 10,000 psi. In other embodiments, these components may be rated for pressures of up to approximately 15,000 psi. The barrier 38 may be used to protect this downstream equipment from the relatively higher fluid pressures experienced upstream, thereby allowing more technically and commercially feasible flowline 22 and riser 24 equipment to be utilized.

Figure 2:
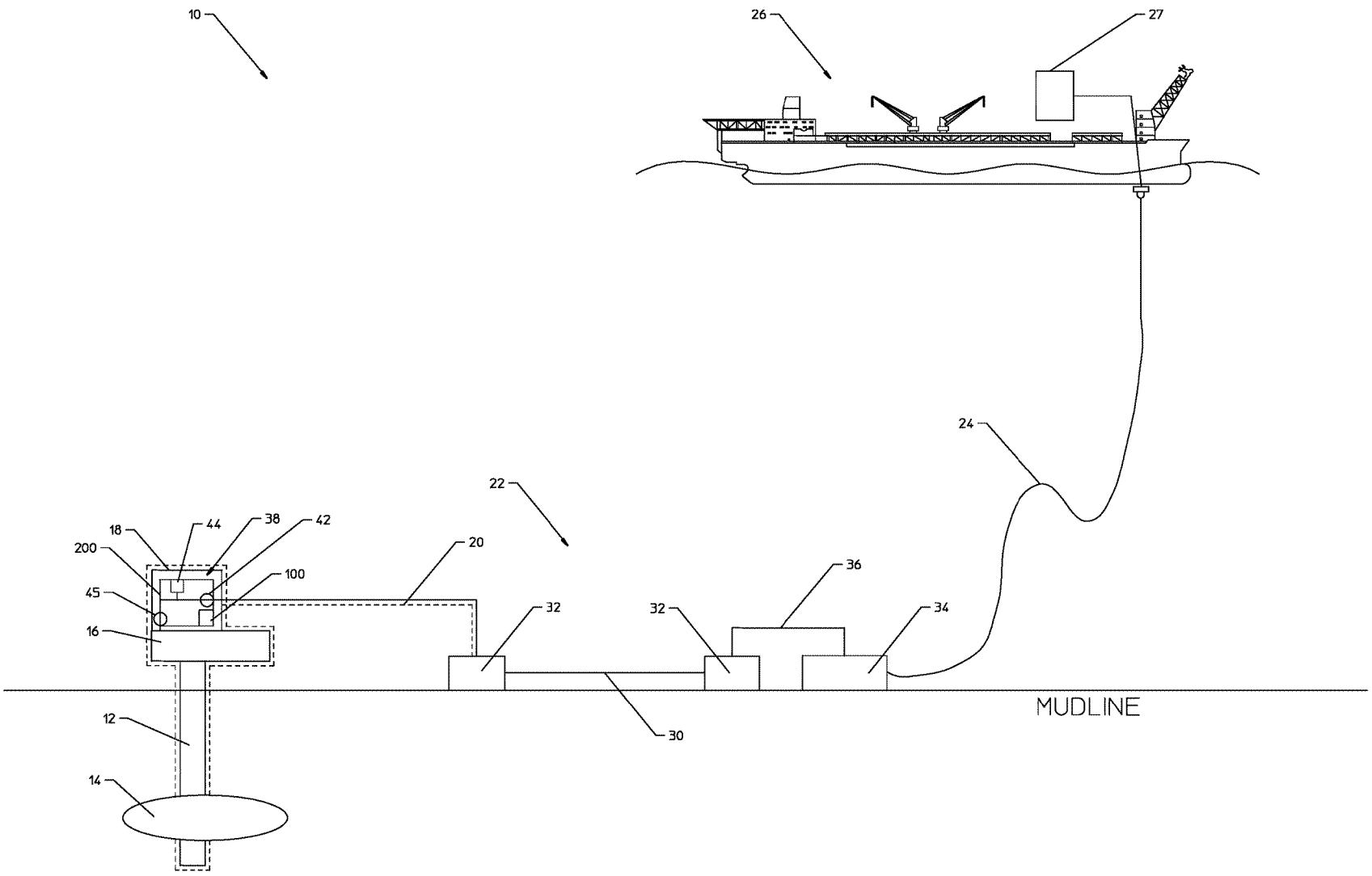
FIG. 2 is a schematic block diagram of a subsea system used to produce fluids from a subsea HPHT well, in accordance with an embodiment of the present disclosure.

Still other arrangements of the subsea system 10 may provide a desired pressure barrier 38 between higher rated and lower rated subsea equipment for use in production of HPHT wells. For example, some embodiments of the subsea system 10 may feature the pressure barrier 38 disposed within the flow loop of the subsea production tree 18 (as shown in FIG. 2) or a THS 16. For example, the pressure barrier 38 may take the form of a HIPPS module 200 that is coupled directly to the production tree 18. In such embodiments, the HIPPS module 200 may utilize valves, a bypass/test circuit, or communication components (for communicating with topside equipment) that are already present in the production tree 18 to establish the pressure barrier 38. In some embodiments, the pressure barrier 38 may include a common design of interfacing hardware that can be used to couple the pressure barrier 38 to different components of the subsea system. For example, the same design for the pressure barrier 38 may be used to interface with equipment including the production tree 18 (e.g., FIG. 2) or similar subsea structures such as manifolds (PLETs/PLEMs) 32 (e.g., FIG. 1).

Figure 3:
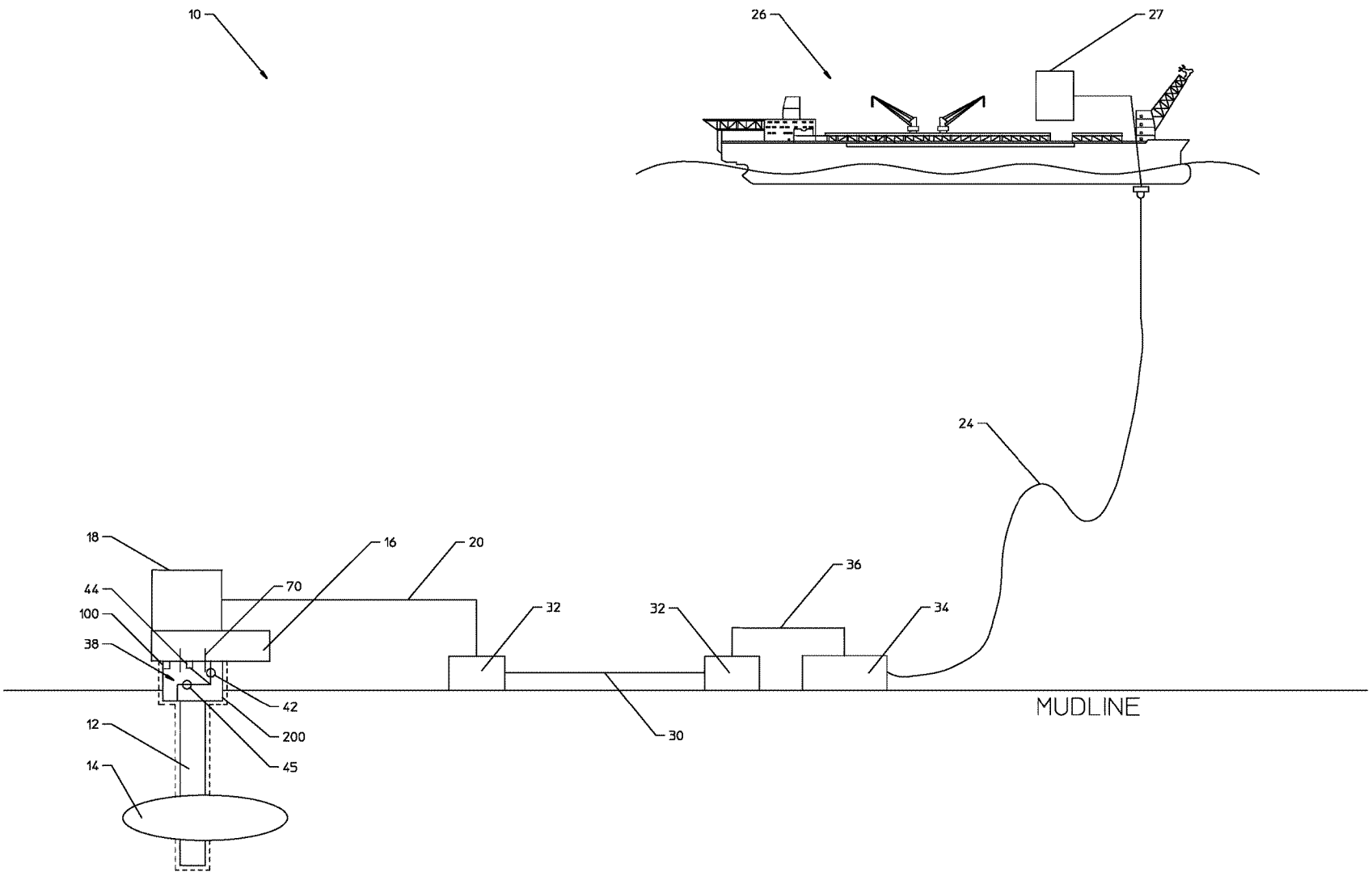
FIG. 3 is a schematic block diagram of a subsea system used to produce fluids from a subsea HPHT well, in accordance with an embodiment of the present disclosure.

As shown in FIG. 3, in other embodiments the pressure barrier 38 may be located within or upstream of the high-pressure wellhead 12 housing and/or a tubing hanger. As noted above, various other arrangements of the barrier 38 may be provided at different locations to separate the fully HPHT rated components of the production system 10 from more conventional equipment (e.g., riser 24, flowline system 22) that are rated for lower pressures.

Figure 4:
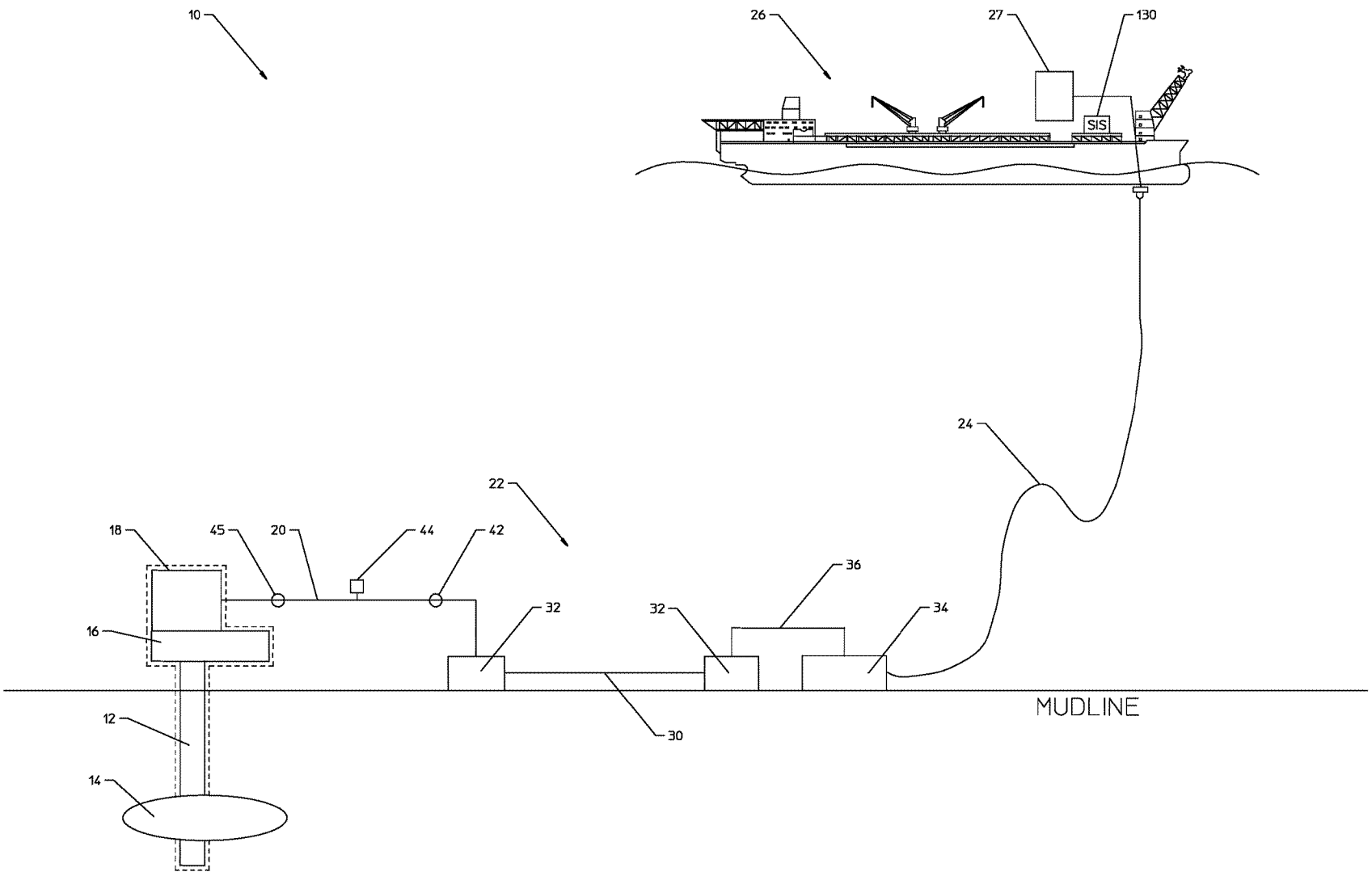
FIG. 4 is a schematic block diagram of a subsea system used to produce fluids from a subsea HPHT well, in accordance with an embodiment of the present disclosure.

FIG. 4 illustrates an embodiment of the subsea system 10 that does not include a separate, skidded HIPPS module 200 for providing a barrier between differently rated components of the system 10. Instead, this embodiment shows the production tree 18 directly coupled to the flowline 30 via a well jumper 20. This system 10 may be particularly suited for use in field conditions where the maximum reservoir pressure of the reservoir 14 is less than approximately 15,000 psi, but certain well operations are expected to increase the mudline pressure to above 15,000 psi. For example, the well operations may include bullheading and/or chemical injection into the wellbore during shut-in or well safe-out operations, thereby raising the pressure through certain subsea system components (e.g., wellhead 12, tree 18, and umbilical equipment) to an excess of 15,000 psi. While the present figure does not include the HIPPS module 200, one of ordinary skill in the art can implement the HIPPS module 200 both as a full subsea module with controls located subsea and/or with the valve interlock embodiment of FIG. 4 with a Safety Instrumented System (SIS) 130.

For this scenario, a fully rated flowline system 22 and riser system 24 may be utilized downstream of the subsea production tree 18. That is, the equipment downstream of the production tree 18 may be rated for a pressure that is equal to the maximum reservoir pressure (i.e., less than 15,000 psi). This effectively eliminates the need for the HIPPS barrier valves described above. The wellhead 12, THS 16, and tree 18, however, may be rated at a pressure equal to or greater than the reservoir pressure plus an expected well operating pressure margin (i.e., greater than 15,000 psi). This higher pressure rating is indicated in FIG. 4 via dashed lines.

Overpressure protection of the lower rated downstream equipment (for example, flowline system 22 and riser system 24) due to chemical injection into the wellbore may be provided via the SIS 130 located on the topsides facility 26, used in conjunction with subsea valve interlocks provided via a subsea control system (not shown). As previously described, the SIS 130 may be a control module disposed anywhere throughout the system 10. The subsea valve interlocks may include a plurality of valves disposed along flowlines about the wellhead 12, tree 16, or other subsea production equipment. The Safety Instrumented System 130 may control these valves together to maintain a desired subsea operational state (i.e., maintaining a lower pressure downstream of the wellhead 12). In this manner, the subsea valve interlocks may function as the pressure barrier in this system 10.

Figure 5A:
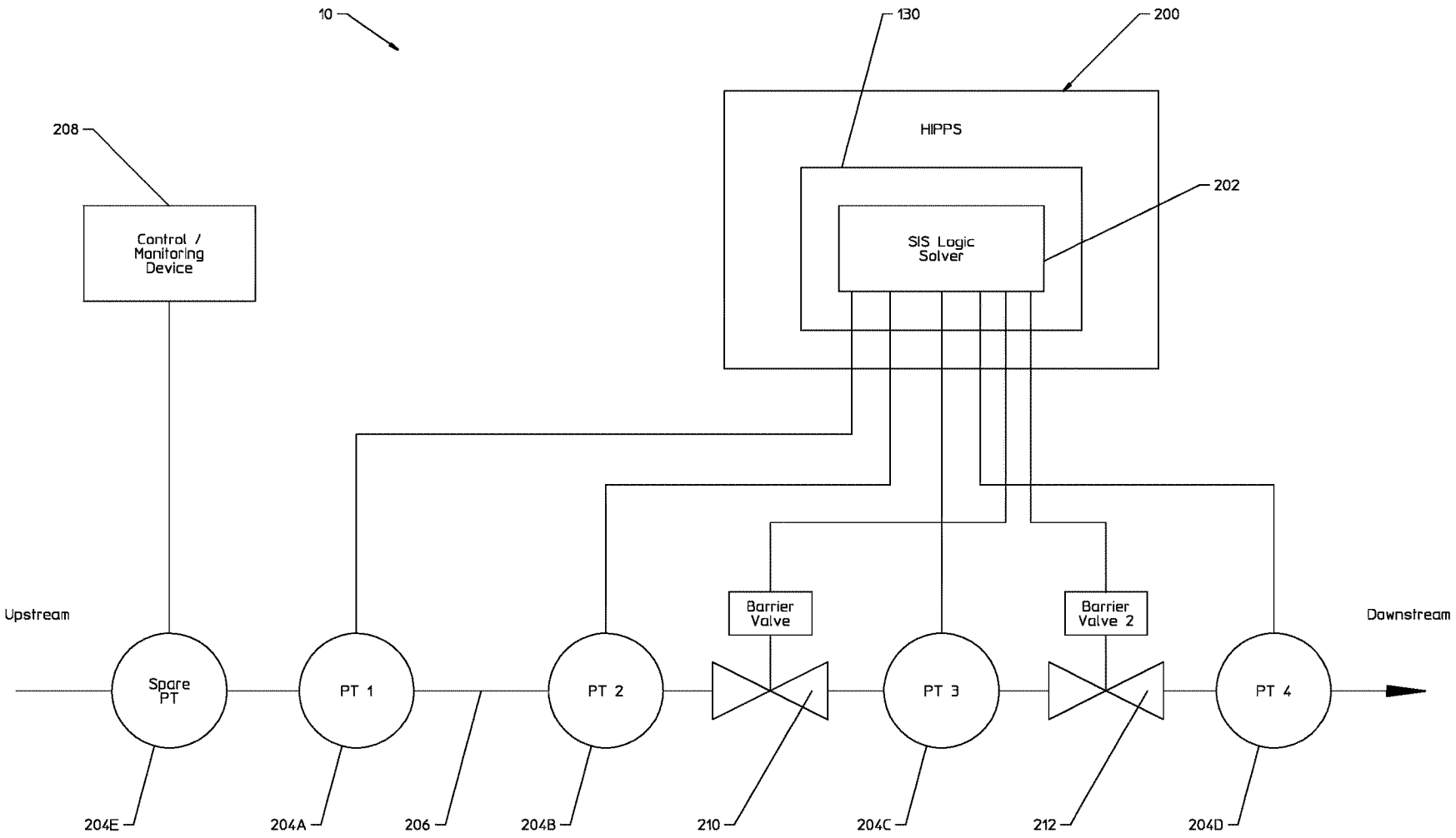
FIGS. 5A-5C illustrate a schematic block diagram of a high integrity pipeline protection system in communication with pressure transmitters and valves, in accordance with an embodiment of the present disclosure.
Figure 5B:
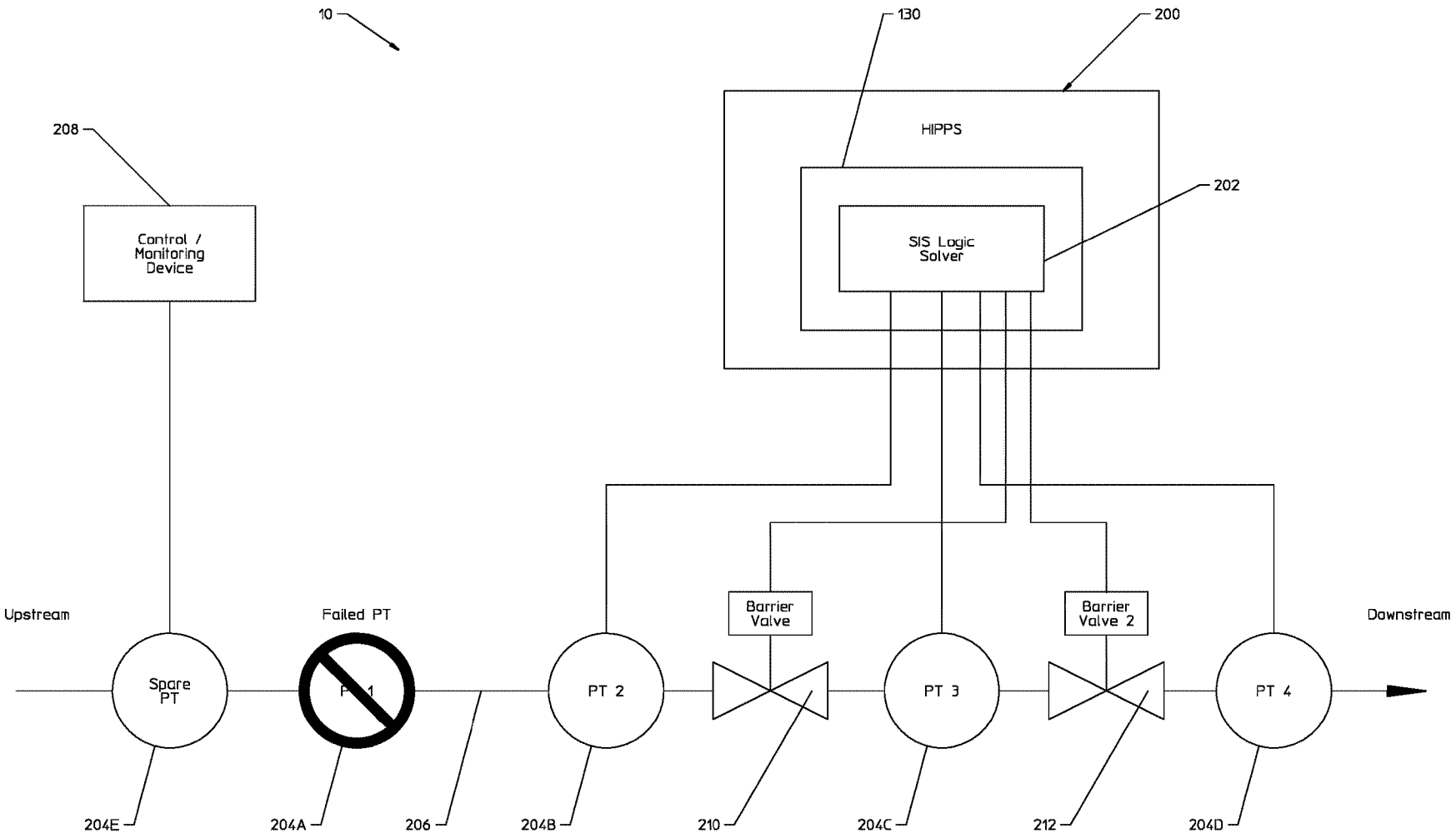
Figure 5C:
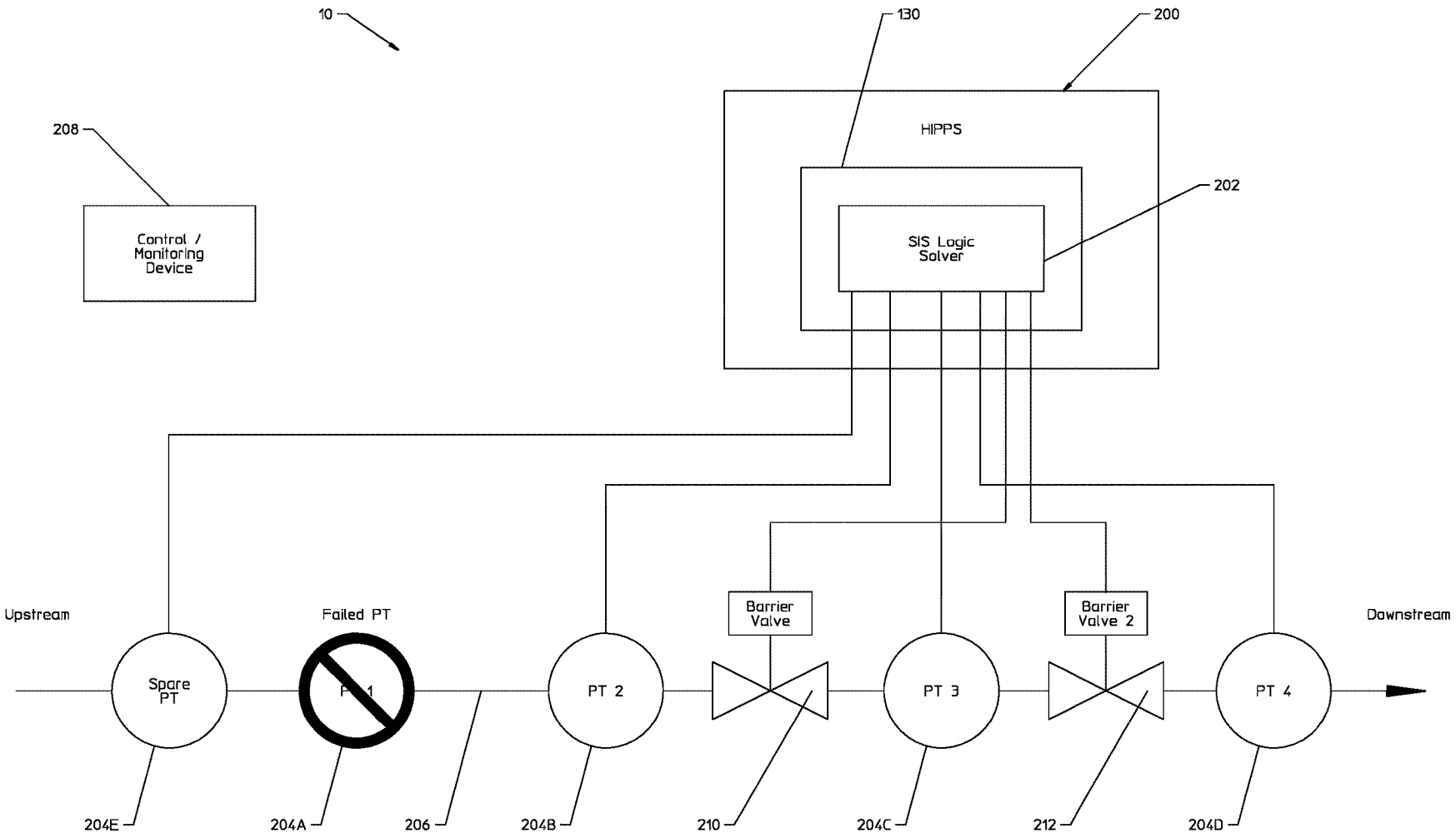

FIGS. 5A-5C illustrate a HIPPS module 200 utilized within the production system 10. As previously described, the HIPPS module 200 may be included as a part of the barrier 38 (referring to FIGS. 1-3). The HIPPS module 200 may be disposed at a topside surface location and/or a subsea location. In embodiments, the HIPPS module 200 may comprise the safety instrumented system (SIS) 130 to monitor pressure throughout the well and a flowpath of produced hydrocarbons to the topside production facility 26 (referring to FIGS. 1-4). The SIS 130 may comprise one or more logic solvers 202 configured to receive an input signal from one or more pressure transmitters 204. In embodiments, the one or more pressure transmitters 204 may be configured to output a pressure signal to the logic solver(s) 202, which may then determine whether or not to close certain valves (for example, a first valve 210 and a second valve 212) based on pressure transmitter measurements. Any suitable pressure transmitter may be utilized as one or more pressure transmitters 204. Without limitations, the one or more pressure transmitters 204 may comprise a sensor, transducer, transmitter, and combinations thereof.

As illustrated, a first pressure transmitter 204A may be disposed about any suitable location along a flowpath 206 of produced hydrocarbons. A second pressure transmitter 204B may be disposed further downstream from the first pressure transmitter 204A along the flowpath 206. A third pressure transmitter 204C may be disposed further downstream from the second pressure transmitter 204B along the flowpath 206. A fourth pressure transmitter 204D may be disposed further downstream from the third pressure transmitter 204C along the flowpath 206. The system may include a spare pressure transmitter 204E disposed upstream of first pressure transmitter 204A. While the one or more pressure transmitters 204 are herein illustrated in one embodiment, the configurations of the one or more pressure transmitters 204 are not limited to such an embodiment. For example, the HIPPS module 200 may include any desired number (e.g., 1, 2, 3, 4, 5, 6, 7, 8, 9, 10, or more) of pressure transmitters 204 located at different positions along the flowpath 206.

As illustrated in FIGS. 5A-5C, all of the one or more pressure transmitters, except for the spare pressure transmitter 204E, may be physically coupled to the one or more logic solvers 202 of the HIPPS module 200 by any suitable means, such as, but without limitation, electrical wires and cabling. The spare pressure transmitter 204E may be physically and/or communicatively coupled to a separate monitoring device 208, wherein the monitoring device 208 may be configured to receive input signals from the spare pressure transmitter 204E during a first mode of operation. In one or more embodiments, the separate monitoring device 208 may be the subsea control module 100 (referring to FIG. 1). In embodiments, the monitoring device 208 may be disposed at the topside production facility 26 (referring to FIGS. 1-4), in a subsea HIPPS module 200, or combinations thereof. The monitoring device 208 may be communicatively coupled to and/or disposed in the information handling system 27 (referring to FIGS. 1-4), the HIPPS module 200, or combinations thereof.

The one or more pressure transmitters 204 (wherein the first pressure transmitter 204A, second pressure transmitter 204B, third pressure transmitter 204C, and fourth pressure transmitter 204D are herein collectively referred to as the one or more pressure transmitters 204) may output pressure signals to the one or more logic solvers 202 of the HIPPS module 200 during the first mode of operation. As the one or more logic solvers 202 receive these pressure signals, the HIPPS module 200 may process the pressure signals and/or transmit the pressure signals to the information handling system 27 to be processed. In embodiments, the one or more pressure transmitters 204 may be utilized to actuate any suitable valve to an open or closed position. This may allocate certain portions of production system 10 as having higher or lower pressure. Operations may continue and/or may be altered based on the pressure signals. During operations, one of the one or more pressure transmitters 204 may fail, as illustrated in FIG. 5B. To maintain a high reliability within the production system 10, the spare pressure transmitter 204E may be reconfigured to be communicatively coupled to the HIPPS module 200 rather than the monitoring device 208 for a second mode of operation. In this embodiment, the spare pressure transmitter 204E may be physically coupled to the one or more logic solvers 202, as illustrated in FIG. 5C, during the second mode of operation. In one or more embodiments, the spare pressure transmitter 204E may be configured to measure data continuously while either offline or online.

FIG. 5A illustrates a normal operating condition within the production system 10 where the first pressure transmitter 204A is physically coupled to the one or more logic solvers 202 of the HIPPS module 200. FIG. 5B illustrates a scenario wherein one of the pressure transmitters 204 (i.e., first pressure transmitter 204A) has failed, thereby resulting in an altered voting logic. FIG. 5C illustrates where the spare pressure transmitter 204E is physically coupled to the one or more logic solvers 202 of the HIPPS module 200 to restore the voting logic back to its original status. As illustrated in FIGS. 5A-5C, a first valve 210 and a second valve 212 may be disposed along the flowpath 206 about the one or more pressure transmitters 204. The first valve 210 may be disposed in between the second pressure transmitter 204B and the third pressure transmitter 204C. The second valve 212 may be disposed between the third pressure transmitter 204C and the fourth pressure transmitter 204D. While the first valve 210 and the second valve 212 are herein illustrated in one embodiment as being disposed between specific pressure transmitters 204, the configurations of the first valve 210 and the second valve 212 are not limited to such an embodiment. Both the first valve 210 and the second valve 212 may be physically coupled to the HIPPS module 200 and may be configured to be actuated by the HIPPS module 200. In one or more embodiments, the HIPPS module 200 comprises the first valve 210 and the second valve 212. In embodiments, the HIPPS module 200 may actuate the first valve 210 and/or the second valve 212 to be open or closed with relation to the flowpath 206 through pressure signals, electrical signals, hydraulics, loss of signal, and any combinations thereof.

Typically, during operations when one of the one or more pressure transmitters 204 fails, the voting logic of the HIPPS module 200 may be changed. Before one of the pressure transmitters 204 fails in the first mode of operation, the voting logic of the HIPPS module 200 may be programmed to actuate at least one of the first valve 210 and/or the second valve 212 to close within the flowpath 206 when at least two of the four pressure transmitters 204 output pressure signals of high pressure. When a pressure transmitter 204 fails, the voting logic of the HIPPS module 200 may be changed to actuate at least one of the first valve 210 and/or the second valve 212 to close within the flowpath 206 when at least one of the three remaining pressure transmitters 204 outputs pressure signals of high pressure. This increases the likelihood of unnecessarily closing valves, thereby decreasing the reliability of the production system 10. By reconfiguring the spare pressure transmitter 204E during the second mode of operation to be communicatively coupled to the HIPPS module 200 when the one of the one or more pressure transmitters 204 fails, the original voting logic may be restored, so that at least one of the first valve 210 and/or the second valve 212 is actuated closed within the flowpath 206 when at least two of the four pressure transmitters 204 output pressure signals of high pressure. As such, the disclosed system helps to maintain a higher reliability for the production system 10.

Figure 6A:
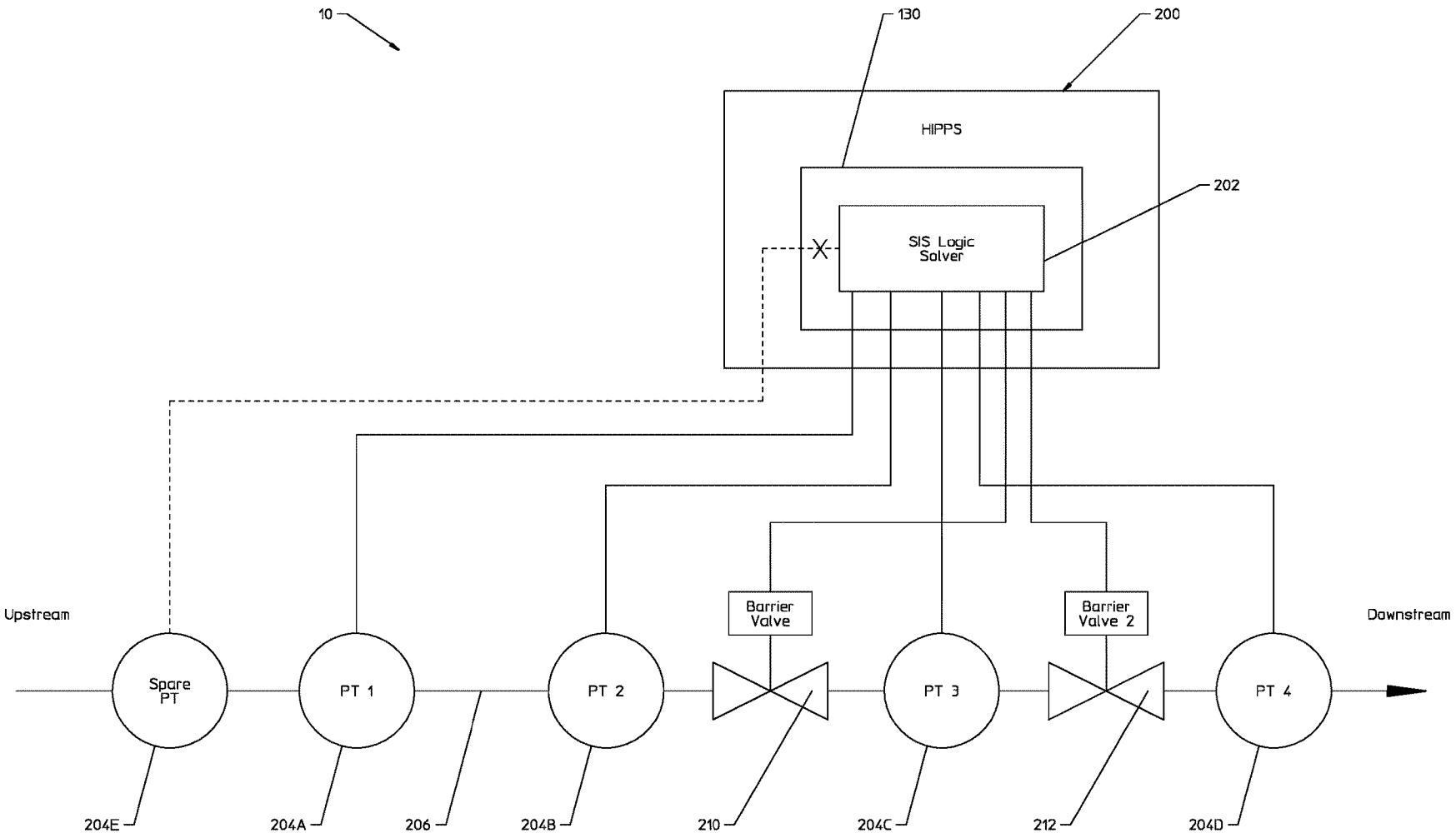
FIGS. 6A-6C illustrate a schematic block diagram of a high integrity pipeline protection system in communication with pressure transmitters and valves, in accordance with an embodiment of the present disclosure.
Figure 6B:
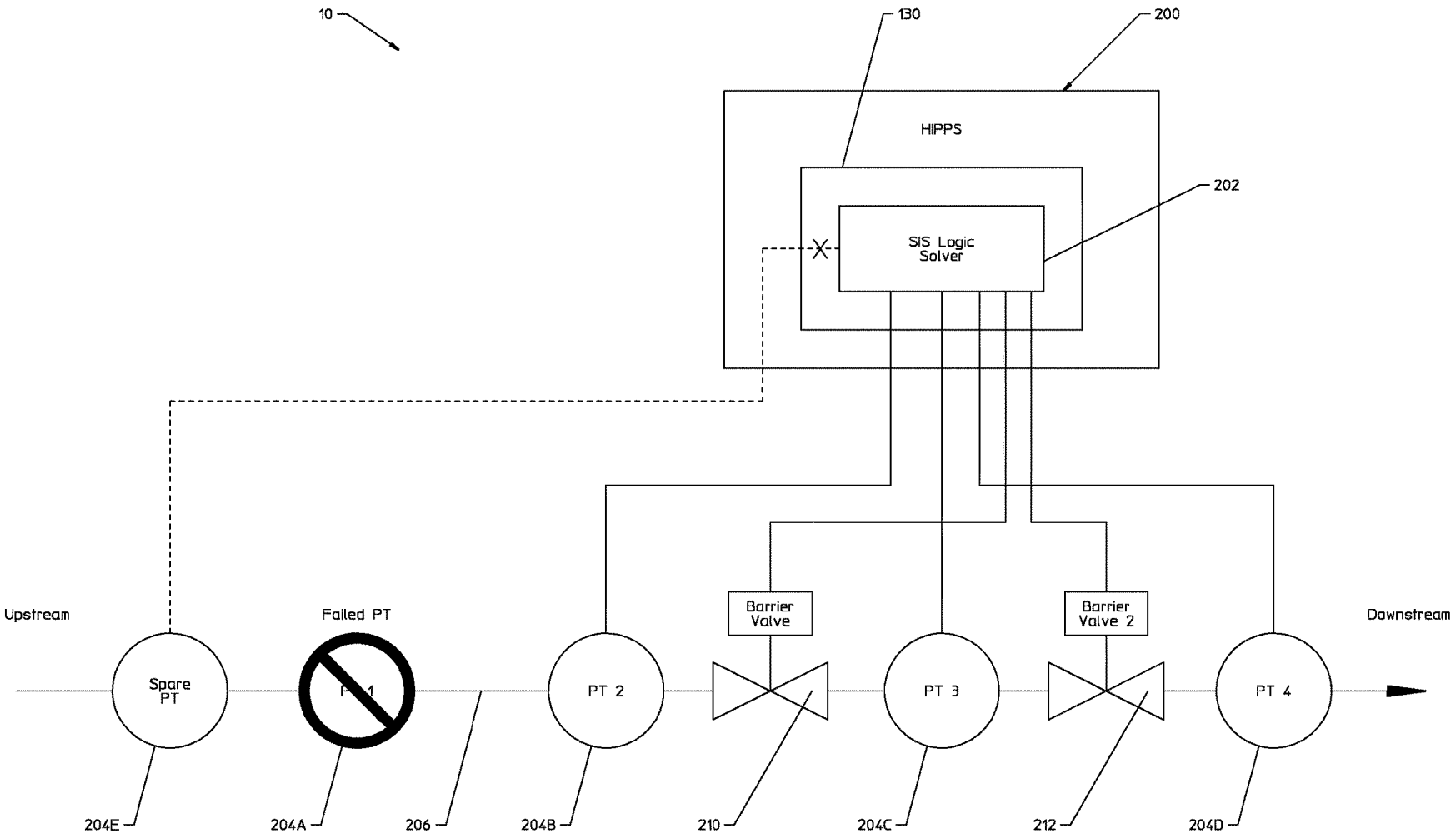
Figure 6C:
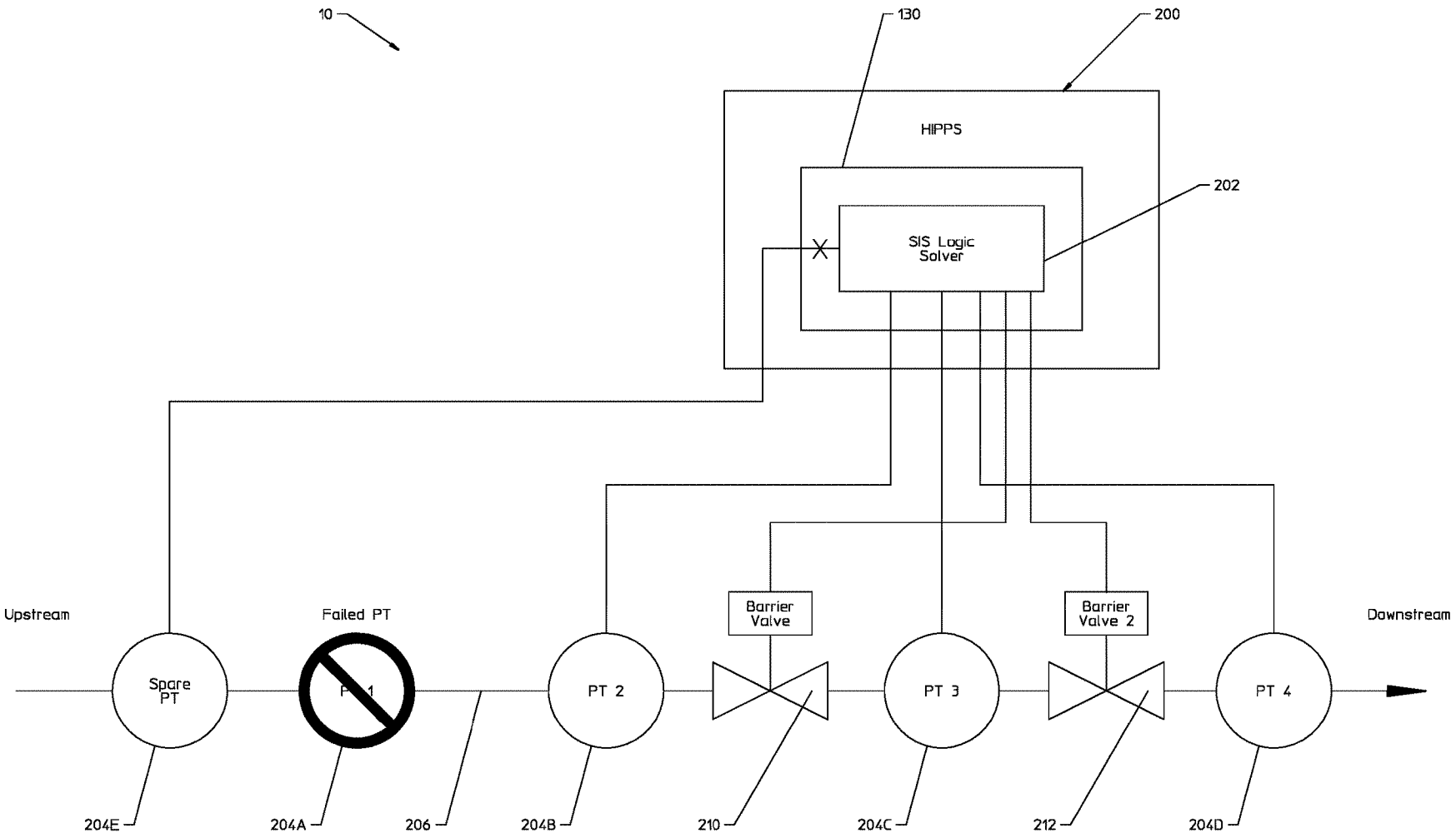

In other embodiments, the spare pressure transmitter 204E may not be coupled to a separate monitoring device 208 from the HIPPS module 200. FIGS. 6A-6C illustrate an embodiment of the HIPPS 200 wherein the spare pressure transmitter 204E may be communicatively coupled to the SIS 130 of the HIPPS module 200 but not the one or more logic solvers 202. As one of the pressure transmitters 204 fails, software present within the HIPPS module 200 may be reconfigured to replace the connection of the failed pressure transmitter 204 and the one or more logic solvers 202 with a new connection of the spare pressure transmitter 204E with the one or more logic solvers 202. FIG. 6A illustrates a normal operating condition within the production system 10 where the first pressure transmitter 204A is communicatively coupled to the SIS 130 of the HIPPS module 200 but not to the one or more logic solvers 202. FIG. 6B illustrates a scenario wherein one of the pressure transmitters 204 (i.e., first pressure transmitter 204A) has failed, thereby resulting in an altered voting logic. FIG. 6C illustrates where the spare pressure transmitter 204E is coupled via software to the one or more logic solvers 202 to restore the voting logic back to its original status.

Figure 7A:
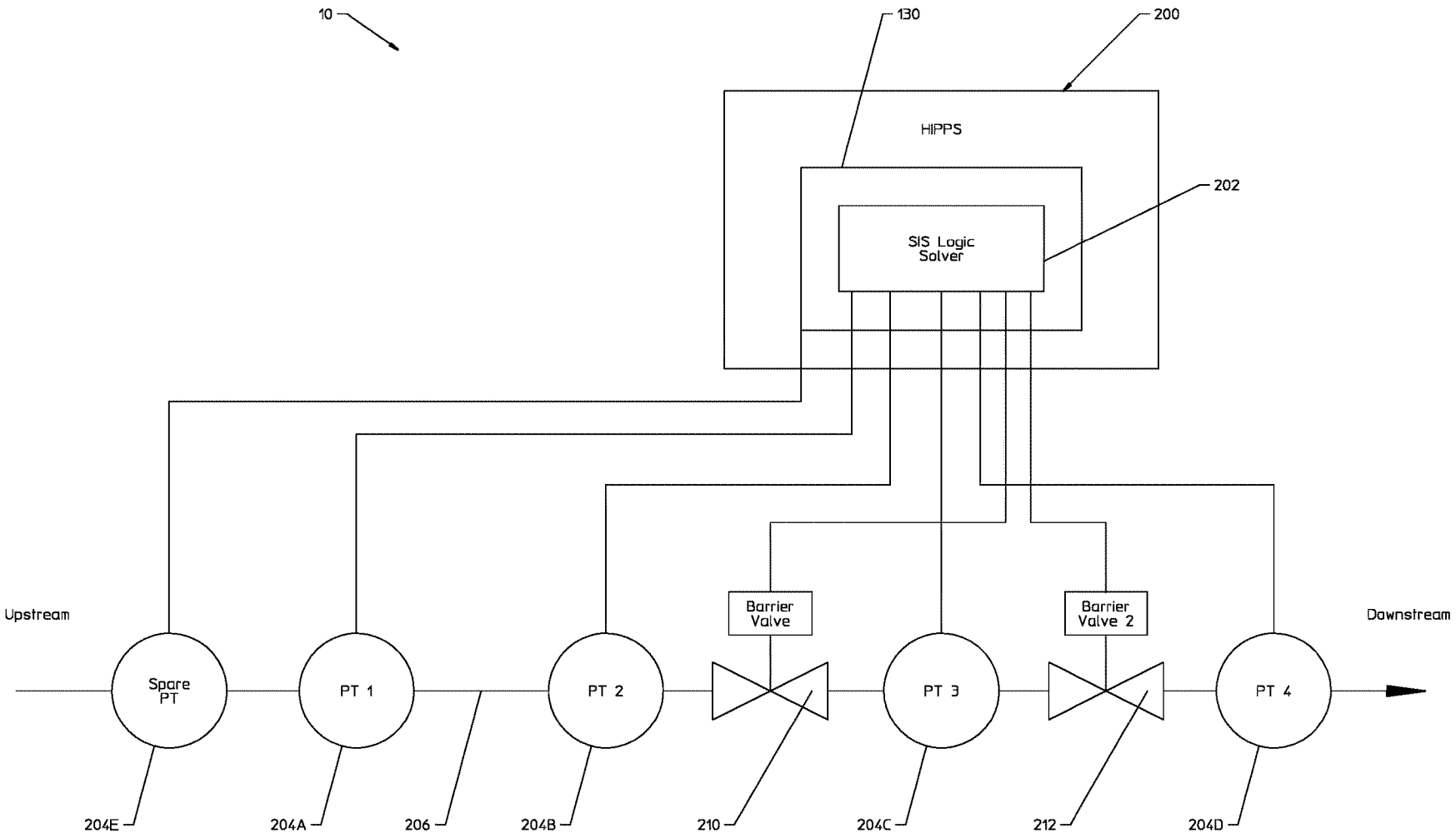
FIGS. 7A-7C. illustrate a schematic block diagram of a high integrity pipeline protection system in communication with pressure transmitters and valves, in accordance with an embodiment of the present disclosure.
Figure 7B:
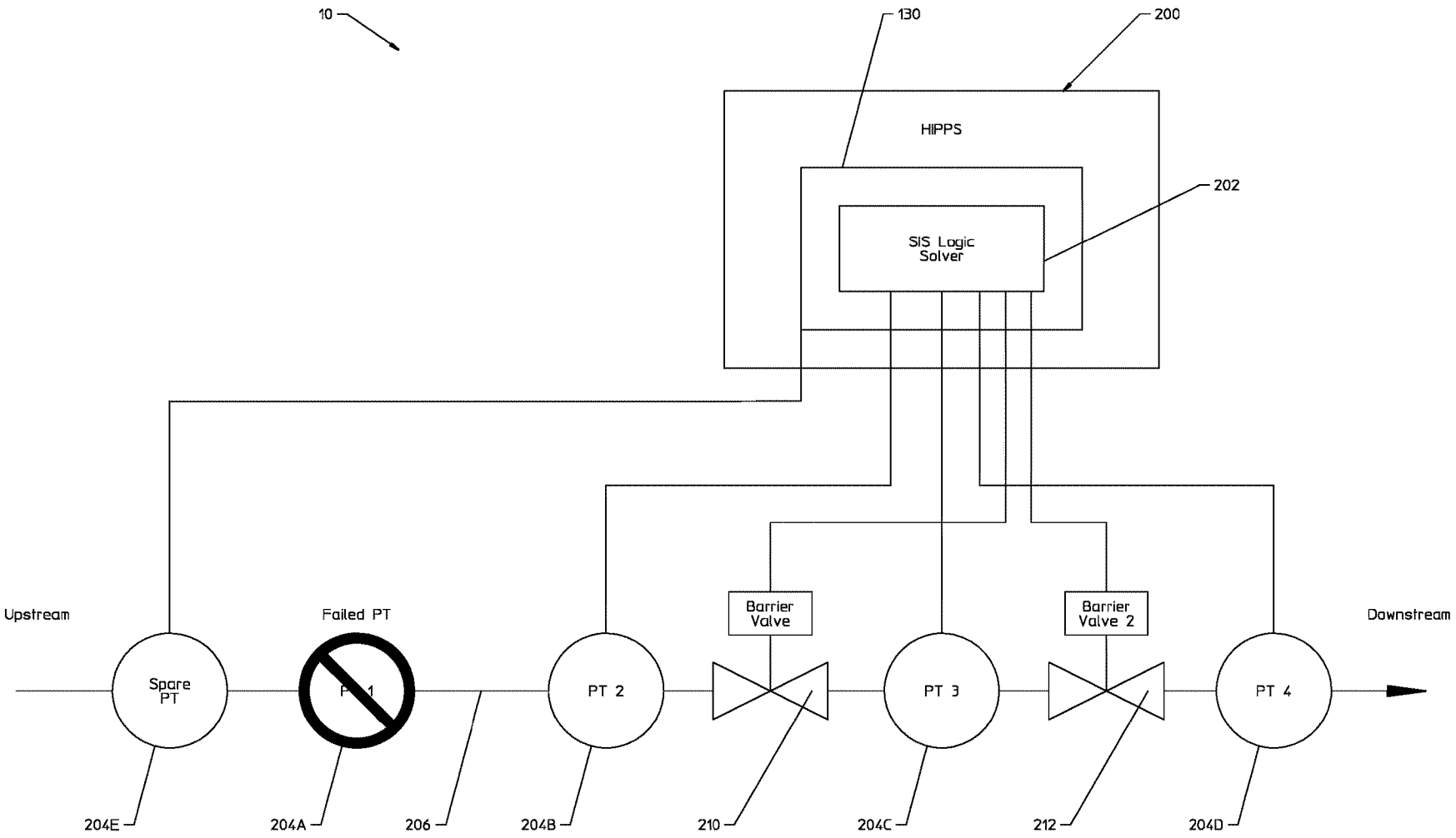
Figure 7C:
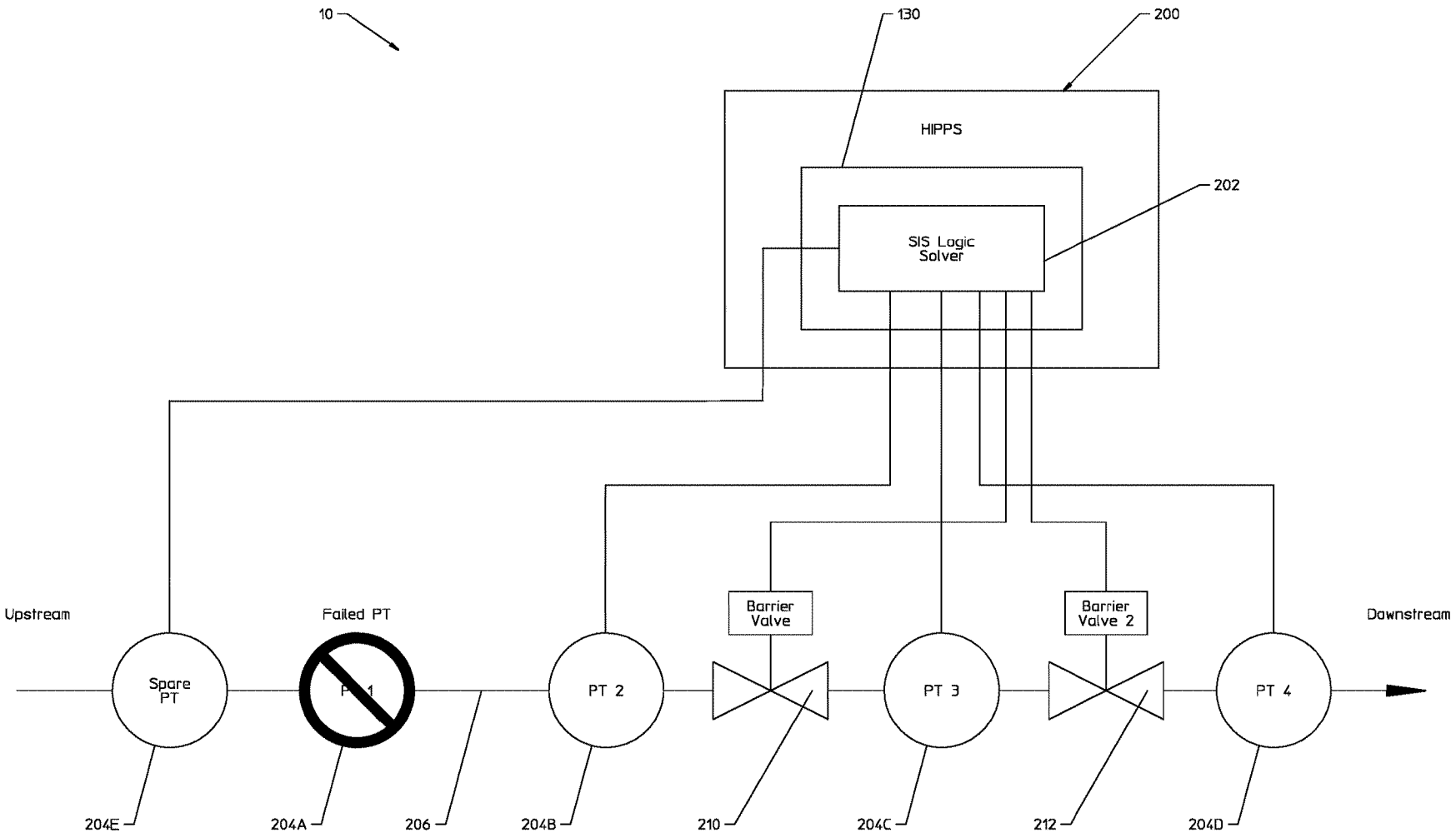

FIGS. 7A-7C illustrate an embodiment of the HIPPS 200 wherein the spare pressure transmitter 204E may be physically coupled to the SIS 130 of the HIPPS module 200 but not the one or more logic solvers 202. As one of the pressure transmitters 204 fails, the physical connection between the failed pressure transmitter 204 and the one or more logic solvers 202 may be replaced by physically coupling the spare pressure transmitter 204E with the one or more logic solvers 202 via a remotely operated vehicle (ROV). FIG. 7A illustrates a normal operating condition within the production system 10 where the first pressure transmitter 204A is physically coupled to the one or more logic solvers 202 of the HIPPS module 200. FIG. 7B illustrates a scenario wherein one of the pressure transmitters 204 (i.e., first pressure transmitter 204A) has failed, thereby resulting in an altered voting logic. FIG. 7C illustrates where the spare pressure transmitter 204E was previously physically coupled to the SIS 130 of the HIPPS module 200, but not the one or more logic solvers 202, and is now re-coupled via an ROV to the one or more logic solvers 202 to restore the voting logic back to its original status.

Although the present disclosure and its advantages have been described in detail, it should be understood that various changes, substitutions and alterations can be made herein without departing from the spirit and scope of the disclosure as defined by the following claims.

What is claimed is:

1. A system, comprising:

a safety instrumented system (SIS) having one or more logic solvers;

one or more pressure transmitters disposed along a flowpath and communicatively coupled to the one or more logic solvers;

one or more valves disposed along the flowpath and communicatively coupled to the SIS, wherein the SIS is configured to selectively actuate the one or more valves based on feedback from the one or more pressure transmitters; and a spare pressure transmitter disposed along the flowpath, wherein the spare pressure transmitter is configured to be selectively coupled to the one or more logic solvers.

2. The system of claim 1, further comprising a monitoring device configured to selectively couple the spare pressure transmitter to the one or more logic solvers.

3. The system of claim 2, wherein the spare pressure transmitter is coupled to the monitoring device, wherein the monitoring device is configured to receive input signals from the spare pressure transmitter.

4. The system of claim 3, wherein the spare pressure transmitter is configured to be decoupled from the monitoring device and coupled to the one or more logic solvers to restore a voting logic.

5. The system of claim 1, wherein the spare pressure transmitter is communicatively coupled to the SIS and is configured to be communicatively coupled to the one or more logic solvers via software to restore a voting logic.

6. The system of claim 1, wherein the spare pressure transmitter is physically connected to the SIS and configured to be physically coupled to the one or more logic solvers to restore a voting logic.

7. The system of claim 1, wherein the one or more pressure transmitters and the one or more valves each form part of a barrier disposed along the flowpath, the barrier providing a pressure barrier between components located upstream of the barrier and components located downstream of the barrier.

8. A non-transitory computer-readable medium comprising instructions that are configured, when executed by a processor, to:

receive signals transmitted by one or more pressure transmitters disposed along a flowpath and communicatively coupled to one or more logic solvers;

determine a change in a voting logic provided by the one or more pressure transmitters, wherein the voting logic is reduced by failure of one of the one or more pressure transmitters;

actuate one or more valves disposed along the flowpath based, at least in part, on feedback from the one or more pressure transmitters; and couple a spare pressure transmitter to the one or more logic solvers to restore the voting logic.

9. The non-transitory computer-readable medium of claim 8, wherein the instructions are further configured to:

actuate the one or more valves disposed along the flowpath based, at least in part, on feedback from the spare pressure transmitter.

10. The non-transitory computer-readable medium of claim 8, wherein the instructions are further configured to:

decouple the spare pressure transmitter from a monitoring device prior to coupling the spare pressure transmitter to the one or more logic solvers.

11. The non-transitory computer-readable medium of claim 8, wherein the instructions are further configured to:

signal a remotely operated vehicle to physically couple the spare pressure transmitter to the one or more logic solvers.

12. The non-transitory computer-readable medium of claim 8, wherein the instructions are further configured to:

communicatively connect the spare pressure transmitter to the one or more logic solvers.

13. The non-transitory computer-readable medium of claim 8, wherein the instructions are further configured to:

transmit the received signals to an information handling system at a surface location.

14. A method for restoring a voting logic of one or more transmitters, comprising:

receiving, by a safety instrumented system (SIS), signals transmitted by one or more transmitters disposed along a flowpath and communicatively coupled to one or more logic solvers;

determining a change in voting logic in the SIS based on feedback from the one or more transmitters, wherein the voting logic is reduced by failure of one of the one or more transmitters; and coupling a spare pressure transmitter to the one or more logic solvers within the SIS to restore the voting logic.

15. The method of claim 14, further comprising actuating one or more valves disposed along the flowpath based, at least in part, on feedback from the one or more transmitters and the spare pressure transmitter.

16. The method of claim 14, wherein the spare pressure transmitter is coupled to a monitoring device prior to being coupled to the one or more logic solvers.

17. The method of claim 16, further comprising decoupling the spare pressure transmitter from the monitoring device prior to coupling the spare pressure transmitter to the one or more logic solvers.

18. The method of claim 14, further comprising actuating a remotely operated vehicle to physically couple the spare pressure transmitter to the one or more logic solvers, wherein the spare pressure transmitter is physically connected to the SIS prior to being coupled to the one or more logic solvers.

19. The method of claim 14, further comprising communicatively connecting the spare pressure transmitter to the one or more logic solvers via software, wherein the spare pressure transmitter is communicatively connected to the SIS prior to being coupled to the one or more logic solvers.

20. The method of claim 15, wherein the one or more transmitters and the one or more valves each form part of a barrier disposed along the flowpath, the barrier providing a pressure barrier between components located upstream of the barrier and components located downstream of the barrier.

* * * * *